US007327320B2

(12) United States Patent
Dejean

(10) Patent No.: US 7,327,320 B2
(45) Date of Patent: Feb. 5, 2008

(54) BROADBAND ANTENNA ARRANGEMENT

(75) Inventor: Cédric Dejean, St. Gallen (CH)

(73) Assignee: Huber + Suhner AG, Herisau (CH)

( * ) Notice: Subject to any disclaimer, the term of this patent is extended or adjusted under 35 U.S.C. 154(b) by 0 days.

(21) Appl. No.: 11/257,966

(22) Filed: Oct. 25, 2005

(65) Prior Publication Data

US 2006/0033669 A1 Feb. 16, 2006

Related U.S. Application Data

(63) Continuation of application No. PCT/CH03/00275, filed on Apr. 28, 2003.

(51) Int. Cl.
*H01Q 1/24* (2006.01)

(52) U.S. Cl. ..... 343/702; 343/700 MS; 343/713

(58) Field of Classification Search ..... 343/700 M, 343/702, 846, 906, 700 MS, 713, 715
See application file for complete search history.

(56) References Cited

U.S. PATENT DOCUMENTS 3,508,271 A * 4/1970 Kuecken ..... 343/745
3,605,097 A * 9/1971 Hadik-Barkoczy ..... 343/739
5,294,938 A 3/1994 Matsuo et al.
5,760,744 A 6/1998 Sauer
6,366,260 B1 * 4/2002 Carrender ..... 343/866
6,590,541 B1 * 7/2003 Schultze ..... 343/741
6,734,791 B2 * 5/2004 Kelly et al. ..... 340/445
6,950,068 B2 * 9/2005 Bordi et al. ..... 343/702
2002/0180643 A1 12/2002 Laubner et al.

FOREIGN PATENT DOCUMENTS

GB 2 351 395 B 12/2000
JP 63009206 A * 1/1988
WO 01/26182 A1 4/2001

* cited by examiner

*Primary Examiner*—Tho Phan
(74) *Attorney, Agent, or Firm*—Burr & Brown

(57) ABSTRACT

The invention relates to a compact and robust broadband antenna, for the frequency range from about 800 MHz up to 9 GHz, in particular, for use on railways. The antenna includes a monopole antenna element, extending in a longitudinal direction essentially parallel to and at a distance above a planar electrically-conducting base plate, between two opposing ends of the antenna element. The antenna element is electrically connected to the base plate at the first end thereof and is insulated from the base plate at the second end thereof, creating an injection point by means of which the antenna element may be connected to a device operating at high frequency.

16 Claims, 7 Drawing Sheets

BROADBAND ANTENNA ARRANGEMENT

CROSS REFERENCE TO RELATED APPLICATION

This application is a continuation of International Application Serial No. PCT/CH03/000275, having an international filing date of Apr. 28, 2003, which designated the United States, the entirety of which is incorporated herein by reference.

FIELD OF THE INVENTION

The present invention relates to the field of antenna technology. It relates in particular to a physically compact and mechanically robust monopole broadband vehicle antenna capable of operating in the frequency range between about 800 MHz and 9 GHz, and which has a sufficiently high current carrying capacity to be suitable for specific use in high current applications (on board trains, for example).

BACKGROUND OF THE INVENTION

The geometric dimensions of antennas are closely related to the wavelength of the waves which are intended to be emitted or received via the antennas. Frequently the space available for the antennas is restricted (in the case of portable radio appliances, for example). Consequently, the antennas should be designed to be as compact as possible, without restricting the bandwidth or the efficiency of the antennas.

A number of proposals have already been made in the past for folded monopoles to be used as compact antennas. These monopole antennas are arranged in the form of a hairpin above an electrically conductive base plane, with one end being conductively connected (grounded) to the base plane, while the other end is used as a feed point independently of the base plane. See, for example, U.S. Pat. Nos. 3,295,137 and 3,508,271.

The characteristic properties of unfilled and filled monopoles folded two or more times have also been investigated in an article by B. J. Lamberty, "A Class of Low Gain Broadband Antennas", 1958 IRE Wescon Convention Report, pp. 251-259 (August 1958).

More recently, folded monopoles have been used to allow a radio link for portable computers (see, for example, U.S. Pat. No. 6,054,955) or to provide wire-free price labeling systems via LANs (see, for example, U.S. Pat. No. 5,668,560).

Vehicle antennas for use in the railroad field are subject to unique requirements. Local antennas such as these should be designed in individual cases for a frequency range from 870 MHz to 2170 MHz with a VSWR of <2, thus being suitable for the GMS 900, GSM 1800 and UMTS ranges. They should also be compact and mechanically robust in order to allow a reliable radio link despite the vibration, bugs and other environmental influences. Furthermore, owing to possible contact with the overhead wire on electrified sections of track, local antennas must, in accordance with the relevant test instructions, withstand in particular voltages of 16.6 kV and currents of 40 kA, in which case a voltage of no more than 60 V may occur at the RF connection, in order that personnel in the locomotive are not endangered by the downward feed cable. Examples of local antennas such as these are the K70 20 21 type antennas for the frequency range from 410 to 470 MHz, and the 742 325 type for the frequency range from 870 to 2170 MHz from the Kathrein Company. A broadband vehicle antenna which is resistant to heavy currents is also described in DE-A1-199 24 349.

SUMMARY OF THE INVENTION

One object of the invention is to provide a broadband antenna arrangement which is not only physically compact but is also mechanically robust and, in particular, is suitable for use as a vehicle antenna in the railroad field. A further object is for the capability to use the antenna arrangement in a frequency range from about 800 MHz up to several GHz (e.g., 9 GHz).

In accordance with one embodiment of the present invention, an antenna element is provided which is in the form of a monopole and extends a distance above a planar, electrically conductive base plate in a longitudinal direction essentially parallel to the base plate between two opposite ends of the antenna element and is electrically conductively connected at the first end of the base plate, and has a feed point, which is isolated from the base plate, at the second end, via which feed point the antenna element can be connected to a radio-frequency device.

According to a first preferred embodiment, a high degree of mechanical robustness and a high current carrying capacity as well as simplified assembly are achieved, because of several combined features: (1) the antenna element is in the form of a solid metal plate which has a constant thickness transversely with respect to the longitudinal direction and is composed of aluminum or an aluminum alloy; (2) the antenna element has a foot at the first end; (3) the antenna element is attached to the base plate by the foot; and (4) the foot has at least one threaded hole or attachment hole, through which the foot is screwed to the base plate.

The design and assembly are particularly simple and functionally reliable if, according to a second preferred embodiment, a coaxial plug connector which is at a right angle to the base plate, and in particular is in the form of a connecting socket, is arranged on the lower face of the base plate in the area of the feed point, with its outer conductor being electrically conductively connected to the base plate and its inner conductor being electrically conductively connected through an opening in the base plate to the feed point of the antenna element. It is also preferred that the connection between the feed point and the inner conductor of the coaxial plug connector is designed to be detachable, in which case an electrically conductive connecting pin which projects downwards at a right angle to the base plate is arranged at the feed point of the antenna element and fits in a socket which is fitted to the inner conductor of the coaxial plug connector.

The connecting pin may in this case be integrally formed on the antenna element. It is then also machined out during the mechanical machining of the antenna element. However, it may also be in the form of a separate push-in pin, and may be pushed into a corresponding opening in the antenna element. This has the advantage that the connecting pin may be composed of a different material, which is optimized for making contact, and may be produced more easily.

In order to protect the antenna element against damaging environmental influences, it is advantageous for the antenna element to be covered on the outside by a removable shroud, which is detachably connected, in particular screwed, to the base plate.

According to another embodiment of the invention, the antenna element has a bar-like base element which runs in the longitudinal direction and to which additional resonant structures are fitted, distributed non-uniformly transversely with respect to the longitudinal direction. The resonant structures preferably comprise elements which are integrally formed on the base element and are oriented at right angles to the base plate.

The resonant structures may in this case be rectangular and/or angled, and may have inclined and/or rounded corners.

BRIEF DESCRIPTION OF THE DRAWINGS

The invention will be explained in more detail in the following text using exemplary embodiments and in conjunction with the drawing, in which.

DETAILED DESCRIPTION OF THE INVENTION

Figure 1:
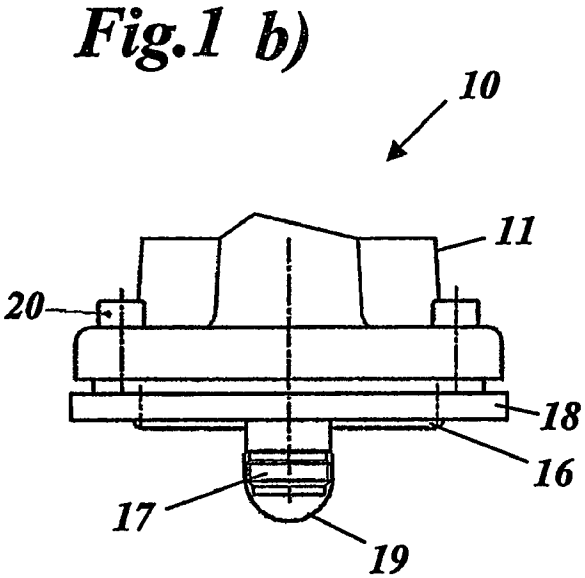
FIG. 1(*a*) is a longitudinal cross-sectional view and FIG. 1(*b*) is a front view of a first embodiment of an antenna according to the present invention, and FIG. 1(*c*) is a detailed view of the plug-in connection.
Figure 1:
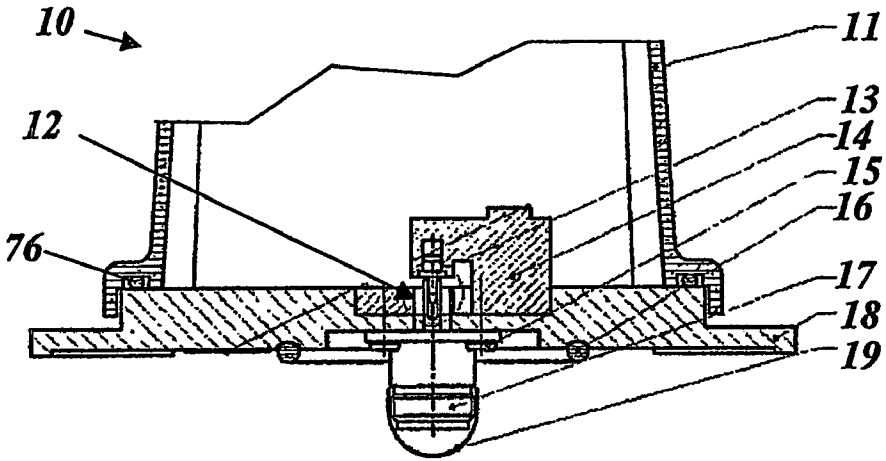
Figure 1:
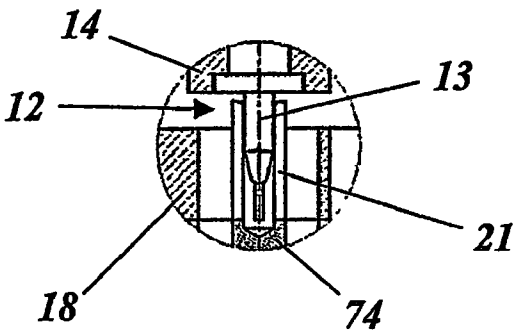

FIGS. 1(*a*)-1(*c*) show different views of a first embodiment of an antenna arrangement according to the present invention. FIG. 1(*a*) shows a longitudinal cross section of the antenna arrangement 10, which is formed on an electrically conductive base plate 18 and is covered by a shroud 11 in the form of a cup. The shroud 11 is preferably composed of a fiber-reinforced plastic and is screwed to the base plate 18 by means of four screws 20, which are screwed into the corresponding threaded holes 34 (FIG. 3) in the base plate. In the first embodiment, the shroud 11 has a flange-like edge with a circumferential groove, in which a sealing ring 76 is inserted to improve the sealing of the internal area from the external area.

As can be seen from FIGS. 1(*a*) and 3, the essentially rectangular base plate 18 has a raised mounting platform 32 in the central area, adjacent to which are two attachment flanges 31, 31' on the transverse faces with two attachment holes 33 provided at each corner. The base plate 18 and thus the entire antenna arrangement 10 can be tightly fastened to a planar outer surface of a vehicle (a locomotive) by means of the four attachment holes 33. Electrical access to the antenna arrangement 10 is gained via an opening in the outer surface of the vehicle, through which a coaxial antenna socket 17, which is arranged on the lower face of the base plate 18, projects into the interior of the vehicle, where it can be connected to a coaxial plug on an antenna cable. The connecting socket 17 is sealed on the outside by a sealing ring 16 which surrounds it and is inserted into an annular groove 38 on the lower face of the base plate 18. When not connected, the coaxial connecting socket 17 can be protected by a protective cap 19.

Figure 2:
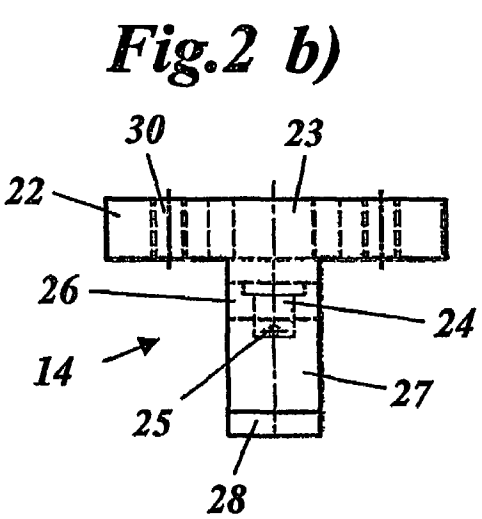
FIG. 2(*a*) is a longitudinal cross-sectional view, FIG. 2(*b*) is a front view and FIG. 2(*c*) is a view from underneath of the antenna element shown in FIGS. 1(*a*)-1(*c*)
Figure 2:
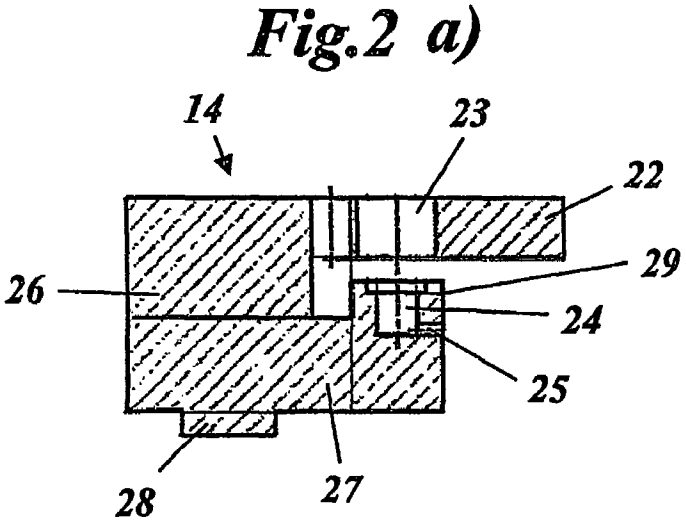
Figure 2:
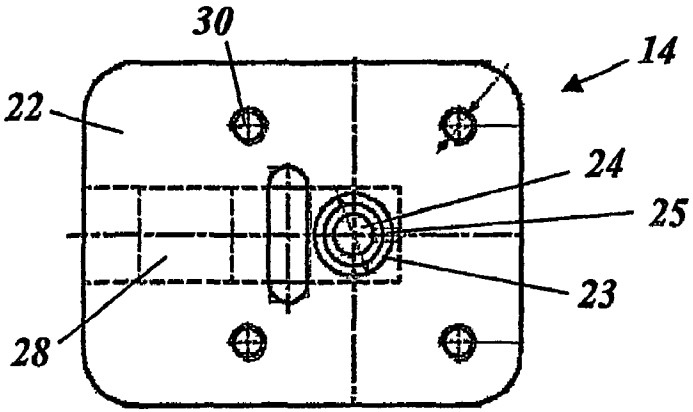

Three different views of the antenna element 14 which is the central component of the antenna arrangement 10 are shown in FIGS. 2(*a*)-2(*c*). The integral antenna element 14, which acts as a monopole, is composed of a semi-hard aluminum alloy. It may be machined from a corresponding metal plate. However, it may also be cast in this shape. It is also feasible for a mount body to be formed from a plastic, which is then provided with an electrically conductive surface coating. The antenna element 14 has a foot 22 with a thickness of about 5 mm in the form of a rectangular plate with rounded corners and external dimensions of about 30 mm×38 mm (FIG. 2(*c*)). The antenna element 14 is inserted with the foot 22 into a corresponding milled area 35 in the mounting platform 32 (FIG. 3), and is screwed to the base plate 18 by means of four threaded holes 30 on the foot 22 and through-holes 36 in the base plate 18. The upper face of the foot 22 is in this case adjacent, without any step, to the upper face of the mounting platform 32, so that, for antenna purposes, the foot 22 is part of the base plate 18. A bar-like base element 27, which extends parallel to the foot plane and at a distance from it, is arranged above the foot 22 (underneath the foot as illustrated in FIGS. 2(*a*)-2(*c*) which are rotated 180°) of the antenna element 14. The base element 27 has a square cross section with a side length of about 8 mm. It can withstand a current surge of 40 kA for a duration of 100 ms without any problems. One end of the base element 27 is connected by a vertical section 26 to the foot 22, and is thus grounded.

Figure 4:
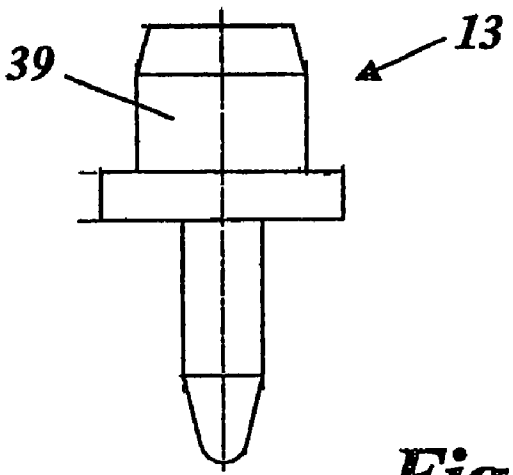
FIG. 4 is an enlarged side view of the connecting pin at the feed point of the antenna arrangement shown in FIGS. 1(*a*)-1(*c*)
Figure 3:
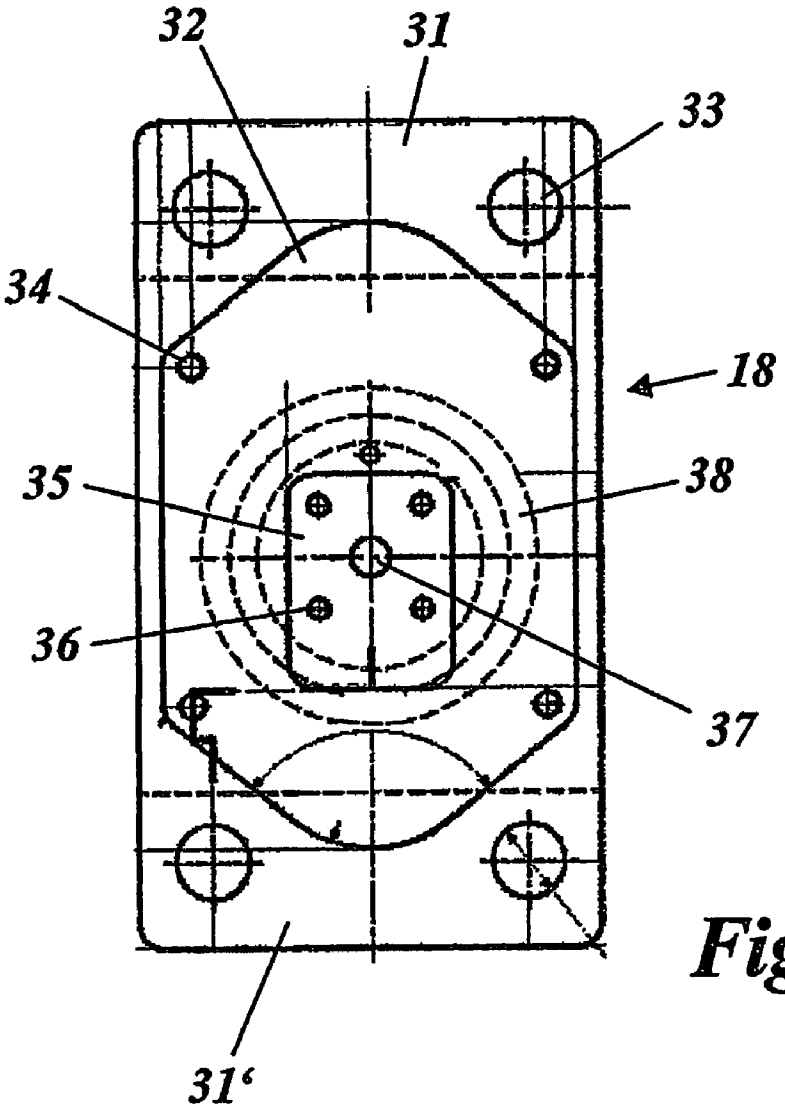
FIG. 3 is a view from above of the base plate of the antenna arrangement shown in FIGS. 1(*a*)-1(*c*)

An attachment 29 which points towards the foot 22 and in which a blind hole 24 is incorporated from the foot 22 is arranged at its other end. A rectangular resonant structure 28 with a square cross section (8 mm side length) and the height of 2 mm is arranged on the upper face of the base element 27. The blind hole 24 is accessible from the outside through a concentric through-hole 23 with a larger diameter in the foot 22. A connecting pin 13, which is in the form of a push-in pin and is composed of brass (FIG. 4), is pushed with its foot 39 into the blind hole 24, so that it projects into the through-hole 23 in the foot 22 and contacts the coaxial connecting socket 17 (feed point 12 of FIG. 1(*a*)) through a corresponding through-hole 37 in the base plate 18 (FIG. 3). This is done by means of the inner conductor 74 of the coaxial connecting socket 17, at whose upper end a longitudinally slotted socket 21 is arranged for holding the connecting pin 13 (FIG. 1(*c*)). The connecting socket 17 is attached by means of four screws, which are screwed into the threaded holes 30 in the foot 22 of the antenna element 14 through the through-holes 36 in the base plate 18. The outer conductor of the coaxial connecting socket 17 is thus conductively connected e.g., grounded to the base plate 18. This configuration results in a functionally reliable and compact connection, which is particularly simple to assemble, between the antenna element 14 and the coaxial connecting socket 17. As can be seen in FIG. 2, the blind hole 24 is connected to the external area through a horizontal connecting channel 25. The connecting channel 25 ensures that, when the connecting pin 13 is pushed in, the expanding air can escape without causing any damage to the rest of the blind hole 24, when the antenna element 14 is heated severely, such as, for example, in the event of possible contact with the overhead line, where the short-circuit current is in the kilo ampere range.

With the abovementioned dimensions and the comparatively small resonator structure 28 on the upper face of the base element 27, the antenna arrangement 10 is designed for a comparatively narrow frequency range from about 5.15-5.875 GHz, as is required for some WLL (wireless local loop) and WLAN (wireless local area network) applications.

Figure 5:
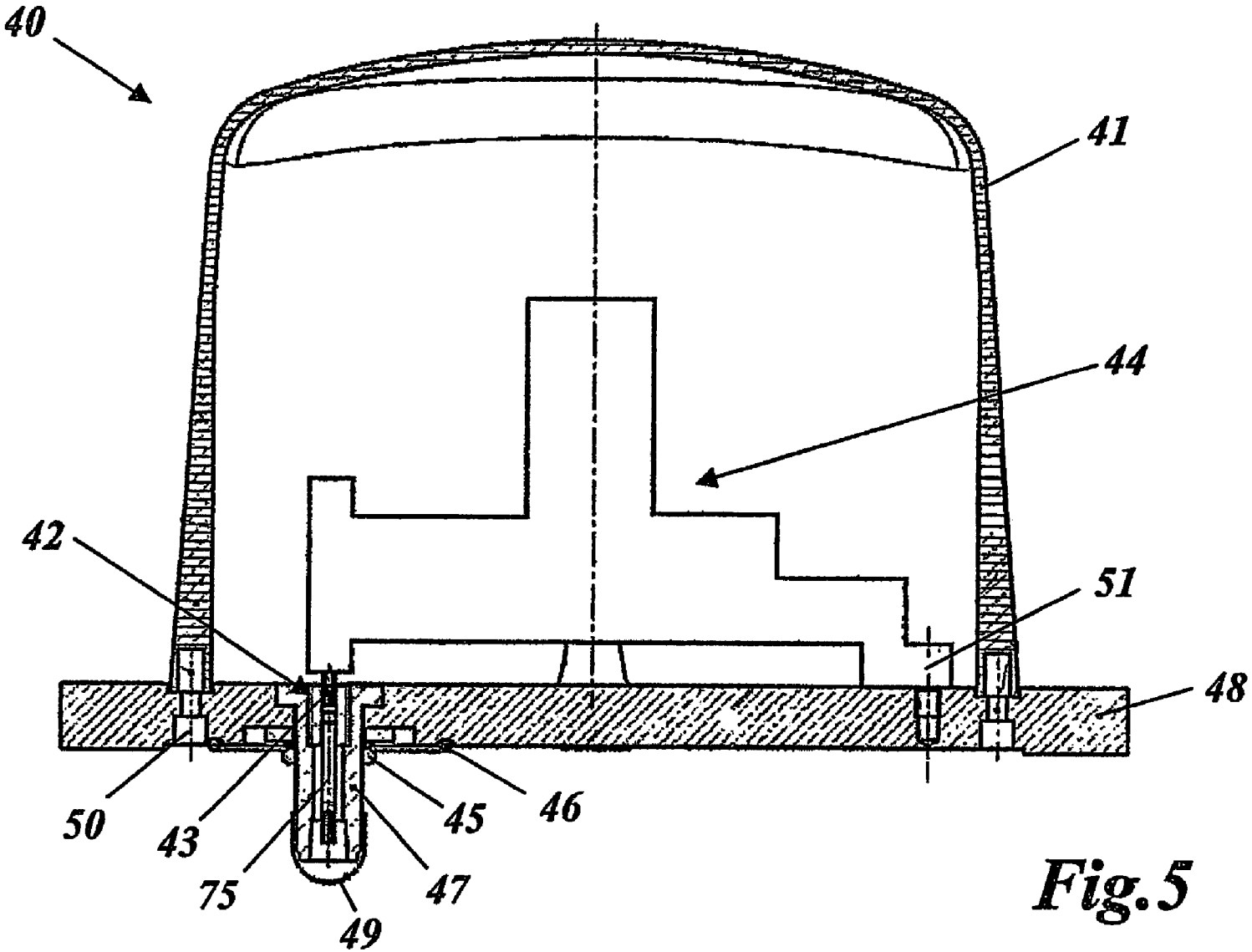
FIG. 5 is a longitudinal cross-sectional view of a second embodiment of the antenna of the present invention.
Figure 6:
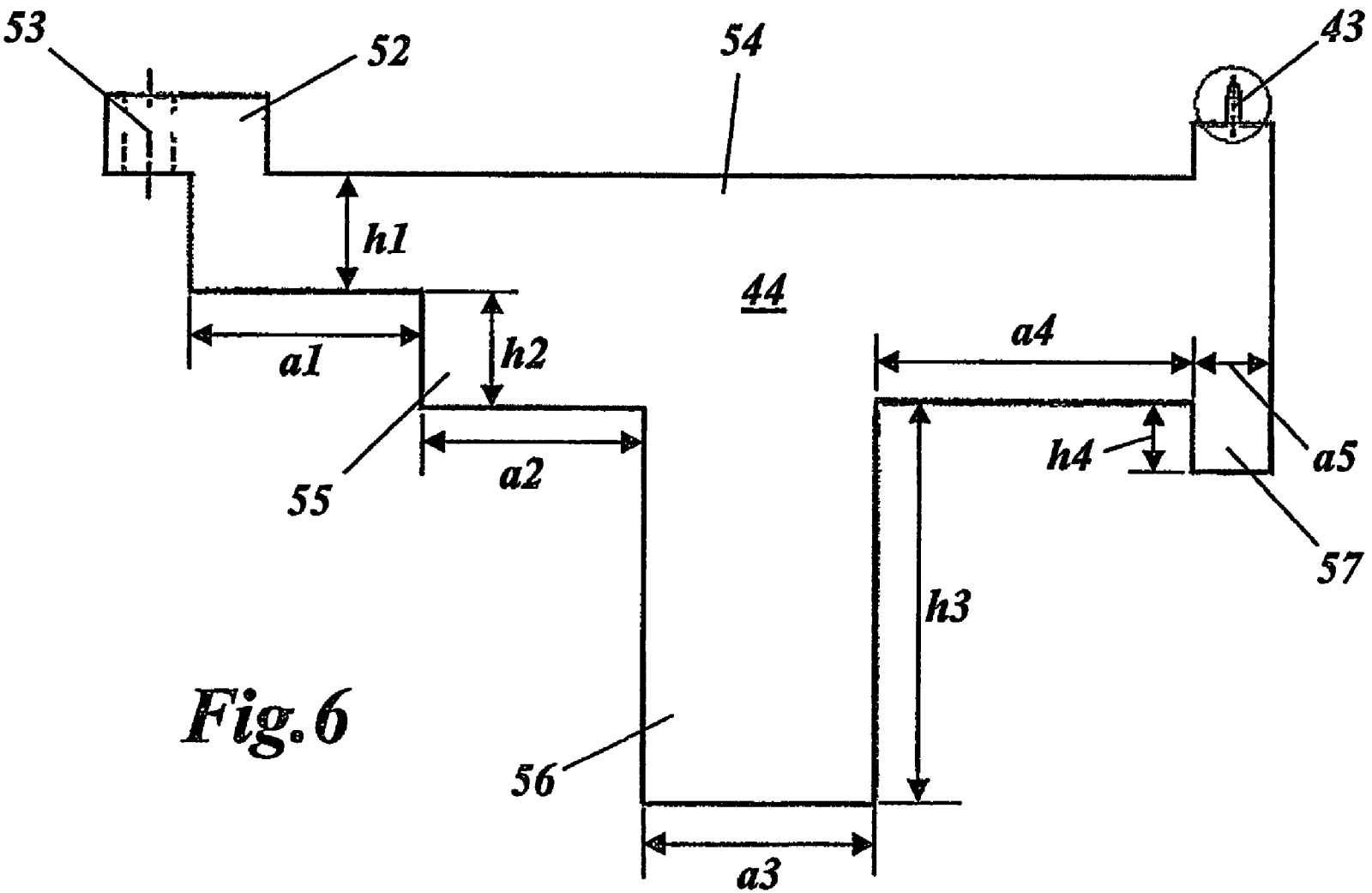
FIG. 6 is a side view of the second embodiment of the antenna element of the antenna arrangement shown in FIG. 5.
Figure 7:
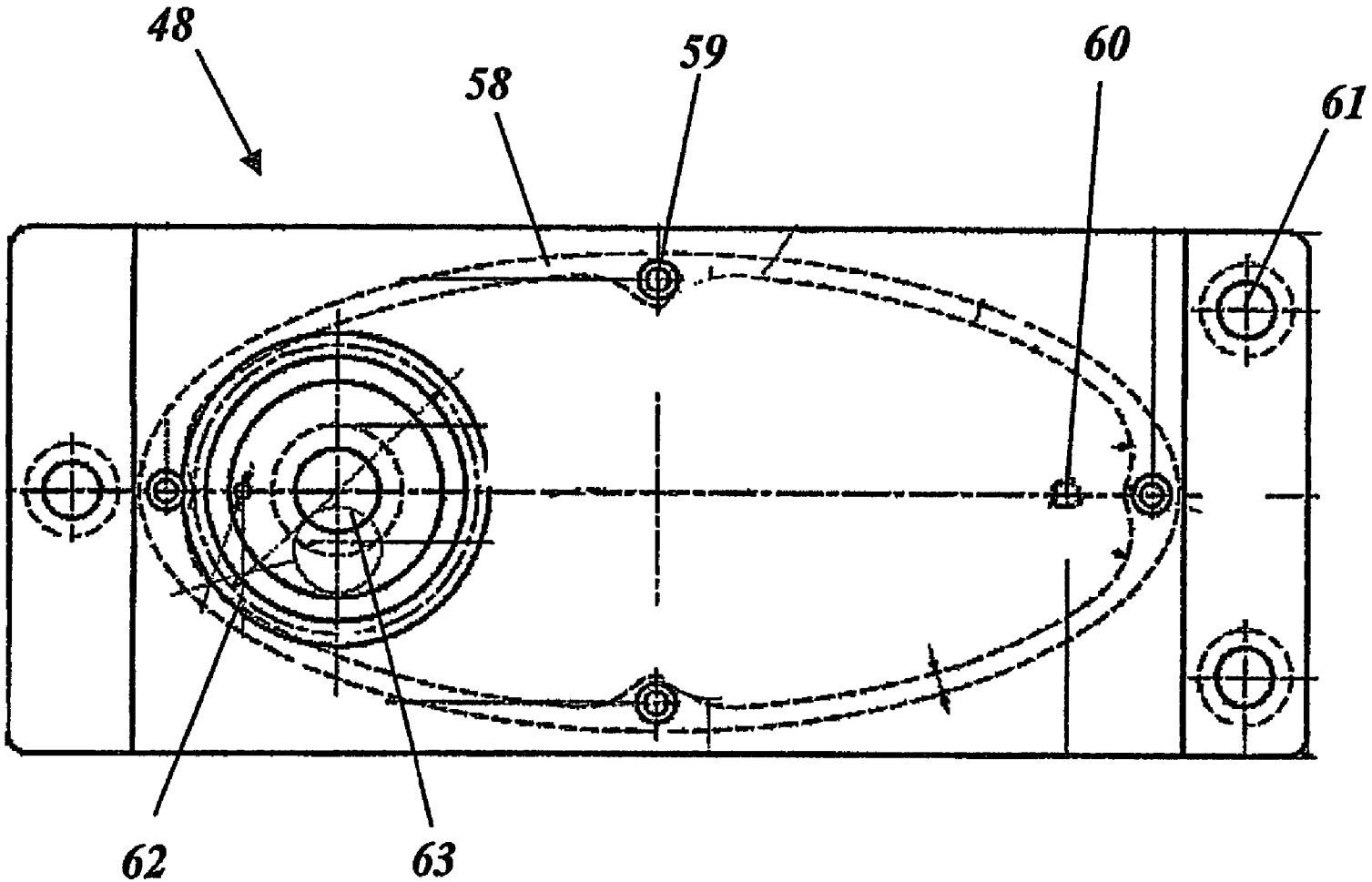
FIG. 7 is a plan view from underneath of the base plate of the antenna arrangement shown in FIG. 5.

In contrast, the antenna arrangement 40 of a second embodiment as illustrated in FIGS. 5-7 can be used for a considerably wider frequency range (e.g., 870 to 2170 MHz). In this case, the antenna arrangement 40, as shown in FIG. 5, has an electrically conductive base plate 48 (see also FIG. 7) composed of a semi-hard aluminum alloy with a plate thickness of 15 mm, an antenna element 44 which acts as a monopole and is mounted on the base plate 48, a coaxial connecting socket 47 whose inner conductor 75 is connected at the feed point 42 to a connecting pin 43 on the antenna element 44, and a protective shroud 41. The lower edge of the shroud 41 is seated in an (elliptical) annular groove 58 (see FIG. 7) in the base plate 48 and is attached to the base plate 48 by means of screws 50, which are screwed into the shroud 41 from underneath through attachment holes 59 in the base plate 48. The coaxial connecting socket 47 is in this case pushed from above through a through-hole 63 in the base plate making electrical contact with an attachment nut 45 which is screwed onto an external thread on the connecting socket 47. A sealing ring 46 is once again provided around the connecting socket 47 and is inserted into a corresponding annular groove 62 on the lower face of the base plate 48. The connecting socket 47 can in turn be protected by a removable protective cap 49. Outside the shroud 41, attachment holes 61 (FIG. 7) are provided in the base plate 48, for attaching the antenna arrangement 40 to the outside of a vehicle.

The antenna element 44 (FIG. 6) comprises a plate composed of semi-hard aluminum alloy with a plate thickness of 10 mm (the plate thickness extends at right angles to the plane of the drawing in FIG. 6). The antenna element 44 has a base element 54, which is like a bar, extends parallel to and at a distance from the base plate 48, and has a height h1 of 15 mm and a length of (a1+a2+a3+a4+a5)=140 mm. An attachment with the connecting pin 43 projecting downwards is provided at one end of the base element 54 (on the right in FIG. 6), towards the base plate 48. The connecting pin 43 is machined from solid in the example. However, it can just as well be in the form of a push-in pin once again. At the other end (on the left in FIG. 6), a foot 52 with an attachment hole 53 is integrally formed, projecting downwards, on the base element 54. The antenna element 44 can be mounted detachably on the base plate 48 by means of the foot 52 and a fastening screw 51. A corresponding threaded hole 60 is provided in the base plate 48 for installing the fastening screw (FIG. 7).

A plurality of resonant structures (55-57) are integrally formed on the base element 54 of the antenna element 44. The first resonant structure 55, for example, corresponds to a step with a height h1 of 15 mm after a distance a1 of 30 mm. The second resonant structure 56, for example, is a vertical bar with a height h3 of about 50 mm and a width a3 of 30 mm. The distance a2 from the step is, for example, about 30 mm. The third resonant structure 57, for example, is a short vertical bar with a width a5 of 10 mm and a height h4 of 9 mm. The dimensions of the resonant structures are one specific embodiment of the present invention provided by way of example. The location and configuration of the resonant structures (55-57) may be varied in different embodiments of the present invention, as appropriate. Further, additional resonant structures may be provided between the two ends of the base element 54, or beyond the screw connection 51.

Figure 8:
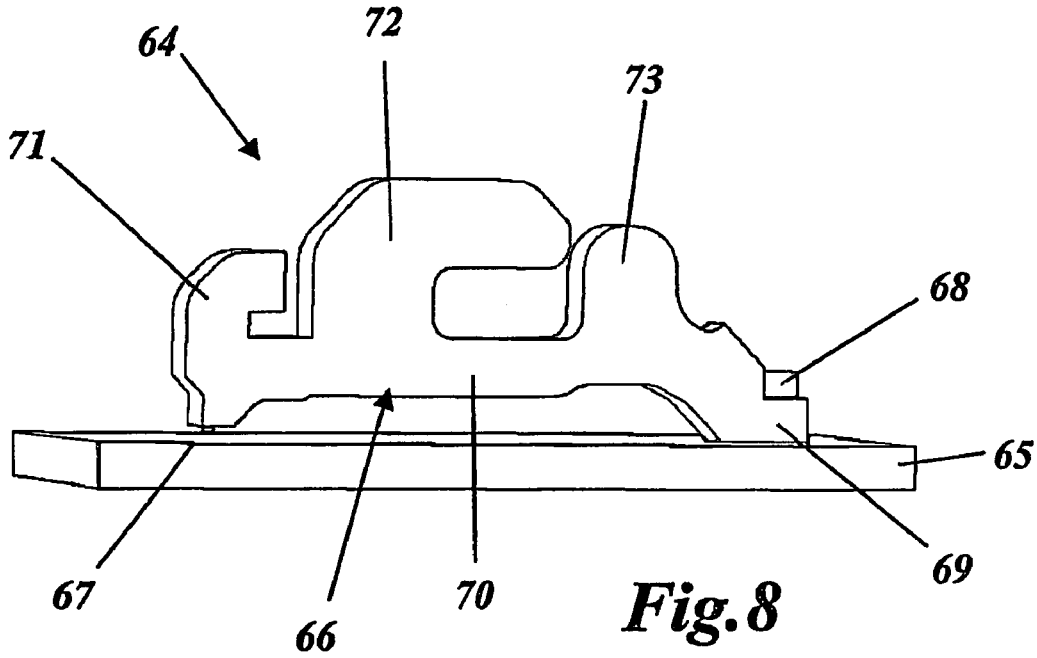
FIG. 8 is a perspective illustration of an antenna arrangement according to a third embodiment of the present invention, with angled and inclined resonant elements.

The resonant structures may also be folded and their ends may be inclined or rounded. One example of an antenna element that has been modified in this way is illustrated in FIG. 8. The antenna element 66 of the antenna arrangement shown in FIG. 8 comprises a bar-like base element 70 which extends parallel to and at a distance from the base plate 65, and which is attached (e.g., by screwing) to the base plate 65 at one end by means of a foot 69. A feed point 67 is located at the other end, at which the antenna element 66 is accessible via a coaxial connecting socket. A plurality of resonant structures 71, 72 and 73 are integrally formed on the base element 70. The resonant structures 71 and 72 are angled (folded); their corners are partially inclined and partially rounded. The corners of the resonant structure 73, which is in the form of a bar, are also rounded.

The antenna element 66 shown in FIG. 8 has dimensions similar to those of the antenna element 44, shown in FIG. 6, providing coverage of the following frequency bands:

| | |
|---|---|
| GSM 900 | 870-960 MHz |
| GSM 1800 | 1710-1880 MHz |
| PCS 1900 | 1850-1990 MHz |
| 1800/UMTS | 1710-2170 MHz |
| WLL/WLAN | 2.4-2.7 GHz; |
| | 3.4-3.7 GHz; |
| | 5.15-5.875 GHz |

The resonant structure 71 broadcasts and receives the low frequencies and the frequencies around 1 GHz. The resonant structure 72 likewise broadcasts and receives low frequencies, but resonates (transmits) mainly below 1 GHz. In this case, the lower face of the base element 70 does not run completely parallel to the base plate 65, but is slightly stepped.

Figure 9:
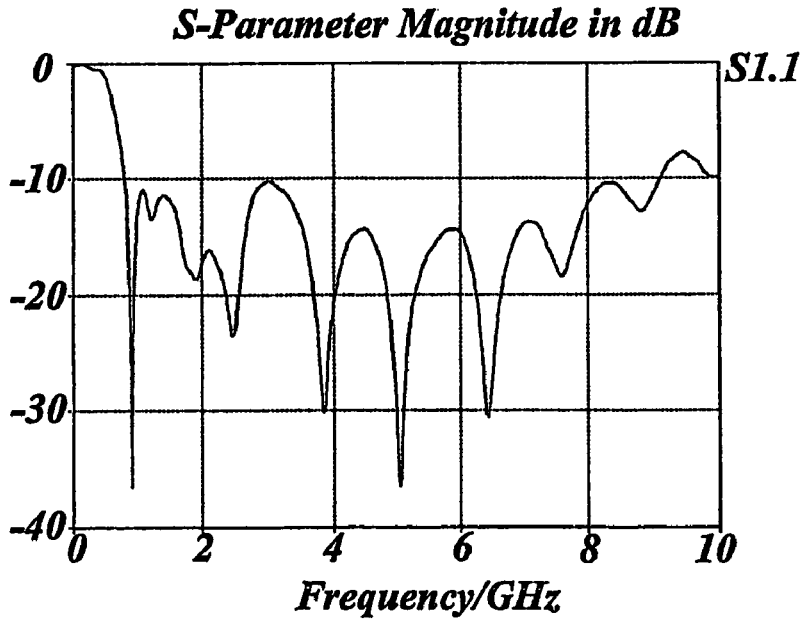
FIG. 9 is a graph showing the relationship between the return loss and the frequency for the antenna arrangement shown in FIG. 8.

The graph in FIG. 9 shows the calculated return loss of the antenna arrangement 64 shown in FIG. 8, plotted against the frequency. As can be seen, the return loss is less than 10 dB between approximately 800 MHz and 9 GHz.

LIST OF REFERENCE SYMBOLS

| | |
|---|---|
| 10, 40, 64 | Antenna arrangement |
| 11, 41 | Shroud |
| 12, 42, 67 | Feed point |
| 13, 43 | Connecting pin |
| 14, 44, 66 | Antenna element (monopole) |
| 15, 68 | Screw |
| 16, 46, 76 | Sealing ring |
| 17, 47 | Connecting socket (coaxial) |
| 18, 48, 65 | Base plate |
| 19, 49 | Protective cap |
| 20, 50 | Screw |
| 21 | Socket |
| 22, 52, 69 | Foot |
| 23 | Through-hole |
| 24 | Blind hole |
| 25 | Connecting channel |
| 26 | Section (vertical) |
| 27, 54, 70 | Base element (like a bar) |
| 28, 55, . . . , 57 | Resonant structure |
| 29 | Attachment |
| 30 | Threaded hole |

-continued

| LIST OF REFERENCE SYMBOLS | |
|---|---|
| 31, 31' | Attachment flange |
| 32 | Mounting platform |
| 33 | Attachment hole |
| 34 | Threaded hole |
| 35 | Milled area |
| 36, 37 | Through-hole |
| 38, 62 | Annular groove (sealing ring) |
| 39 | Foot |
| 45 | Attachment nut |
| 51 | Screw connection |
| 53 | Attachment hole |
| 58 | Annular groove (shroud) |
| 59 | Attachment hole |
| 60 | Threaded hole |
| 61 | Attachment hole |
| 63 | Through-hole |
| 71, 72, 73 | Resonant structure |
| 74, 75 | Inner conductor (connecting socket) |
| a1, . . . , a4 | Distance |
| h1, . . . , h4 | Height |

The invention claimed is:

1. A broadband antenna for transmitting and receiving the frequency range from about 800 MHz to about 9 GHz, comprising:

a monopole antenna element extending in a longitudinal direction substantially parallel to and at a distance above a planar, electrically conductive base plate between two opposite ends of said antenna element, wherein said antenna element is electrically conductively connected at a first end to said base plate, said antenna element has a feed point at a second end thereof, which is electrically isolated from said base plate, wherein said antenna element is adapted to be connected to a radio-frequency device via said feed point;

a coaxial plug connector arranged at a right angle to said base plate, wherein said coaxial plug connector is a connecting socket arranged on a lower face of said base plate near said feed point, wherein an outer conductor of said coaxial plug connector is electrically connected to said base plate such that an inner conductor of said coaxial plug connector is electrically connected through an opening in said base plate to said feed point of said antenna element, and said connection between said feed point and said inner conductor of said coaxial plug connector is detachable, and an electrically conductive connecting pin, which projects downwards at a right angle to said base plate and which is arranged at said feed point of said antenna element, said connecting pin being adapted to fit in a socket connected to said inner conductor of said coaxial plug connector.

2. The antenna of claim 1, wherein said antenna element comprises a solid metal plate having a substantially constant transverse thickness with respect to the longitudinal direction.

3. The antenna of claim 1, wherein said antenna element further comprises a foot at said first end thereof, and said antenna element is attached to said base plate by said foot.

4. The antenna of claim 3, wherein said foot further comprises at least one of a threaded hole and an attachment hole for attaching said foot to said base plate.

5. The antenna of claim 1, wherein said connecting pin is integrally formed on said antenna element.

6. The antenna of claim 1, wherein said connecting pin is a push-in pin, which is pushed into a corresponding opening in said antenna element.

7. The antenna of claim 1, further comprising a removable shroud detachably connected to said base plate to cover said antenna element.

8. The antenna of claim 1, wherein said antenna element comprises a base element which extends in the longitudinal direction and to which additional resonant structures are fitted, wherein said additional resonant structures are distributed non-uniformly transversely with respect to the longitudinal direction.

9. The antenna of claim 8, wherein said resonant structures comprise elements which are integrally formed on said base element and are oriented at right angles to said base plate.

10. The antenna of claim 9, wherein said resonant structures are rectangular.

11. A broadband antenna for transmiffing and receiving the frequency range from about 800 MHz to about 9 GHz, comprising a monopole antenna element extending in a longitudinal direction substantially parallel to and at a distance above a planar, electrically conductive base plate between two opposite ends of said antenna element, wherein said antenna element is electrically conductively connected at a first end to said base plate, and said antenna element has a feed point at a second end thereof which is electrically isolated from said base plate, wherein said antenna element is adapted to be connected to a radio-frequency device via said feed point, wherein said antenna element comprises a base element which extends in the longitudinal direction and to which additional resonant structures are fitted, wherein said additional resonant structures are distributed non-uniformly transversely with respect to the longitudinal direction, and wherein said resonant structures comprise elements which are integrally formed on said base element, are oriented at right angles with respect to said base plate, and are angled.

12. The antenna of claim 11, further comprising a coaxial plug connector arranged at a right angle to said base plate.

13. The antenna of claim 12, wherein said coaxial plug connector is a connecting socket arranged on a lower face of said base plate near said feed point and wherein an outer conductor of said coaxial plug connector is electrically connected to said base plate such that an inner conductor of said coaxial plug connector is electrically connected through an opening in said base plate to said feed point of said antenna element.

14. The antenna of claim 13, wherein the connection between said feed point and said inner conductor of said coaxial plug connector is detachable.

15. A broadband antenna for transmitting and receiving the frequency range from about 800 MHz to about 9 GHz, comprising a monopole antenna element extending in a longitudinal direction substantially parallel to and at a distance above a planar, electrically conductive base plate between two opposite ends of said antenna element, wherein said antenna element is electrically conductively connected at a first end to said base plate, and said antenna element has a feed point at a second end thereof, which is electrically isolated from said base plate, wherein said antenna element is adapted to be connected to a radio-frequency device via said feed point, wherein said antenna element comprises a base element which extends in the longitudinal direction and to which additional resonant structures are fitted, wherein said additional resonant structures are distributed non-uniformly transversely with respect to the longitudinal direction, and wherein said resonant structures have inclined corners.

16. A broadband antenna for transmitting and receiving the frequency range from about 800 MHz to about 9 GHz, comprising a monopole antenna element extending in a longitudinal direction substantially parallel to and at a distance above a planar, electrically conductive base plate between two opposite ends of said antenna element, wherein said antenna element is electrically conductively connected at a first end to said base plate, and said antenna element has a feed point at a second end thereof which is electrically isolated from said base plate, wherein said antenna element is adapted to be connected to a radio-frequency device via said feed point, wherein said antenna element comprises a base element which extends in the longitudinal direction and to which additional resonant structures are fitted, wherein said additional resonant structures are distributed non-uniformly transversely with respect to the longitudinal direction, and wherein said resonant structures have rounded corners.

* * * * *